US006393725B1

(12) United States Patent
Smith et al.

(10) Patent No.: US 6,393,725 B1
(45) Date of Patent: May 28, 2002

(54) COMPACT MICROWAVE CLOTHES DRYER AND METHOD

(75) Inventors: Richard D. Smith, Palo Alto; John F. Gerling; Stephen D. Schultz, both of Modesto, all of CA (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 0 days.

(21) Appl. No.: 09/593,263

(22) Filed: Jun. 13, 2000

(51) Int. Cl.[7] ..... F26B 3/34

(52) U.S. Cl. ..... 34/260; 34/261; 34/265; 34/499; 34/601; 34/607; 34/604; 219/756; 219/757; 219/681

(58) Field of Search ..... 34/260, 261–265, 34/499, 601, 604, 607; 219/756, 757, 681

(56) References Cited

U.S. PATENT DOCUMENTS 3,854,219 A * 12/1974 Staats ..... 34/1
4,356,640 A * 11/1982 Jansson ..... 34/1
4,765,066 A * 8/1988 Yoon ..... 34/1
5,270,509 A 12/1993 Gerling
5,396,715 A 3/1995 Smith
5,483,045 A 1/1996 Gerling
5,546,678 A * 8/1996 Dhaemers ..... 34/275
5,555,641 A * 9/1996 Lee ..... 34/261
5,606,804 A 3/1997 Smith et al.
5,661,227 A 8/1997 Smith et al.
5,983,520 A * 11/1999 Kim et al. ..... 34/261

* cited by examiner

*Primary Examiner*—Denise L. Esquivel
*Assistant Examiner*—Mark Shulman
(74) *Attorney, Agent, or Firm*—Flehr Hohbach Test Albritton & Herbert LLP

(57) ABSTRACT

Compact microwave clothes dryer and method in which the dryer is small enough to be placed on a countertop, and air is circulated past microwave generator and power supply components to the drying chamber to transfer heat from the components to clothes in the chamber to supplement the microwave drying.

14 Claims, 6 Drawing Sheets

COMPACT MICROWAVE CLOTHES DRYER AND METHOD

This invention pertains generally to the drying of clothes and, more particularly, to a compact microwave clothes dryer and method.

Conventional clothes dryers use heated air to vaporize the moisture in clothes. The air must be sufficiently hot to enable the convective transfer of heat to the moisture and obtain an acceptable rate of drying. The resulting temperatures can cause excessive wear to some fabrics and damage to others.

Microwave clothes dryers were first envisioned as a means to transfer heat energy directly to the moisture in clothes without the need for hot air. This results in lower drying temperatures and reduced fabric wear, as well as being faster and more energy efficient. It also permits the drying of delicate fabrics that might otherwise require dry cleaning. Studies have shown that the concept of microwave clothes dryers is technically feasible, but that the practical and economic feasibility of full size residential dryers is questionable. Consequently, microwave clothes dryers may not be able to completely replace conventional clothes dryers.

It is in general an object of the invention to provide a new and improved microwave clothes dryer and method.

Another object of the invention is to provide a microwave clothes dryer and method of the above character which overcome the limitations and disadvantages of microwave clothes dryers heretofore provided.

Another object of the invention is to provide a microwave clothes dryer of the above character which is compact in size and efficient in operation.

These and other objects are achieved in accordance with the invention by providing a compact microwave clothes dryer and method in which the dryer is small enough to be placed on a countertop, and air is circulated past microwave generator and power supply components and through the drying chamber to transfer heat from the components clothes in the chamber to supplement the microwave drying.

Figure 1:
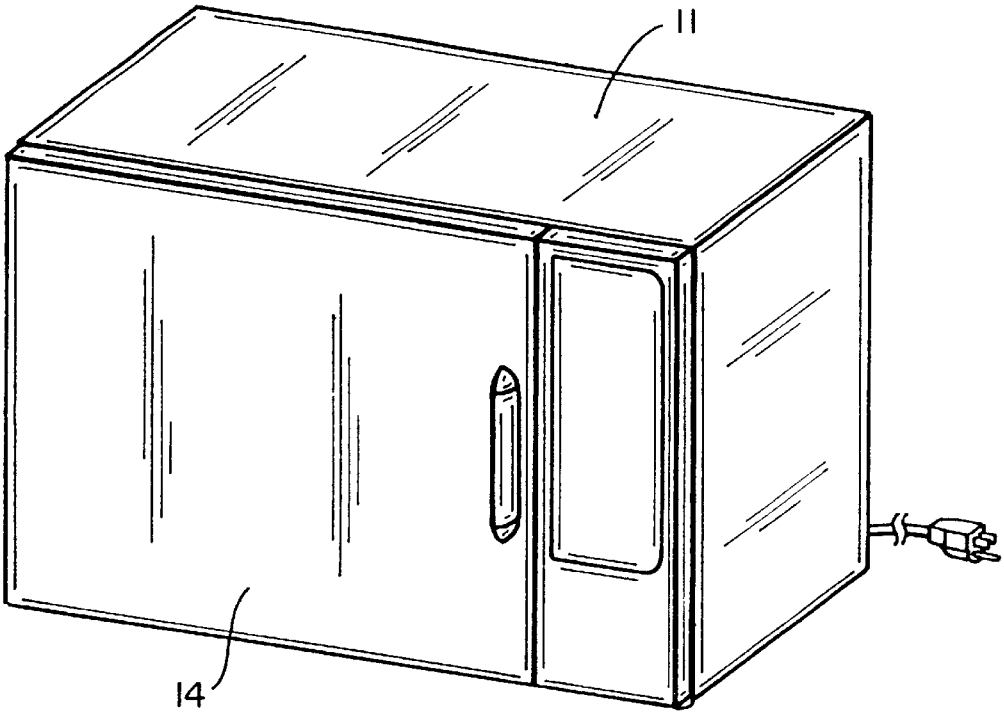
FIG. 1 is a front isometric view of one embodiment of a compact microwave clothes dryer incorporating the invention.
Figure 2:
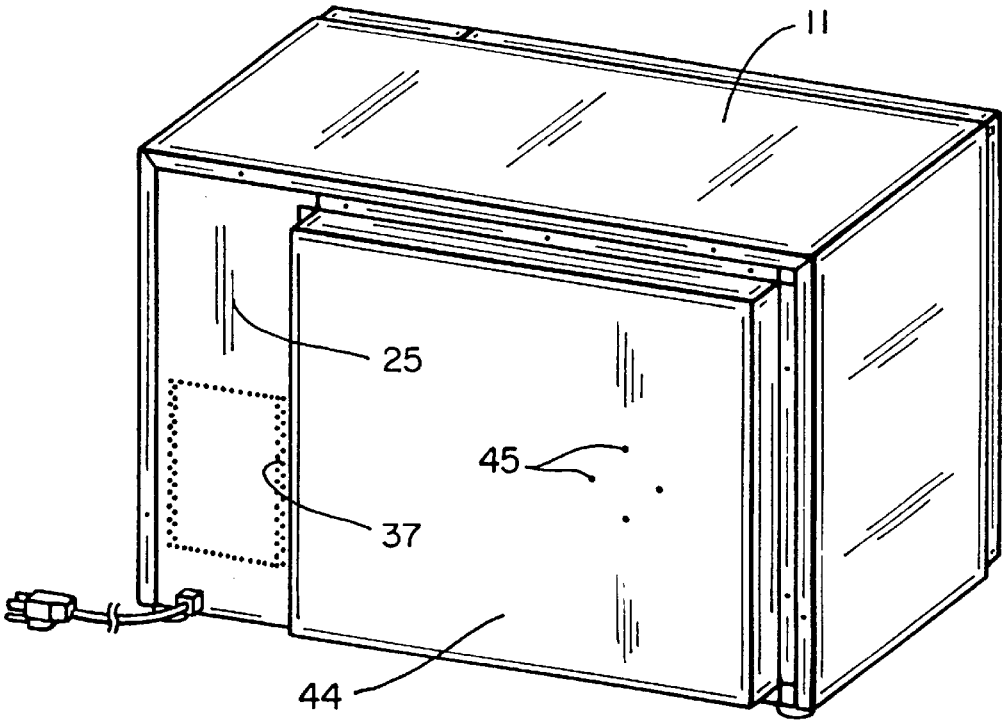
FIG. 2 is a rear isometric view of the embodiment of FIG. 1.
Figure 3:
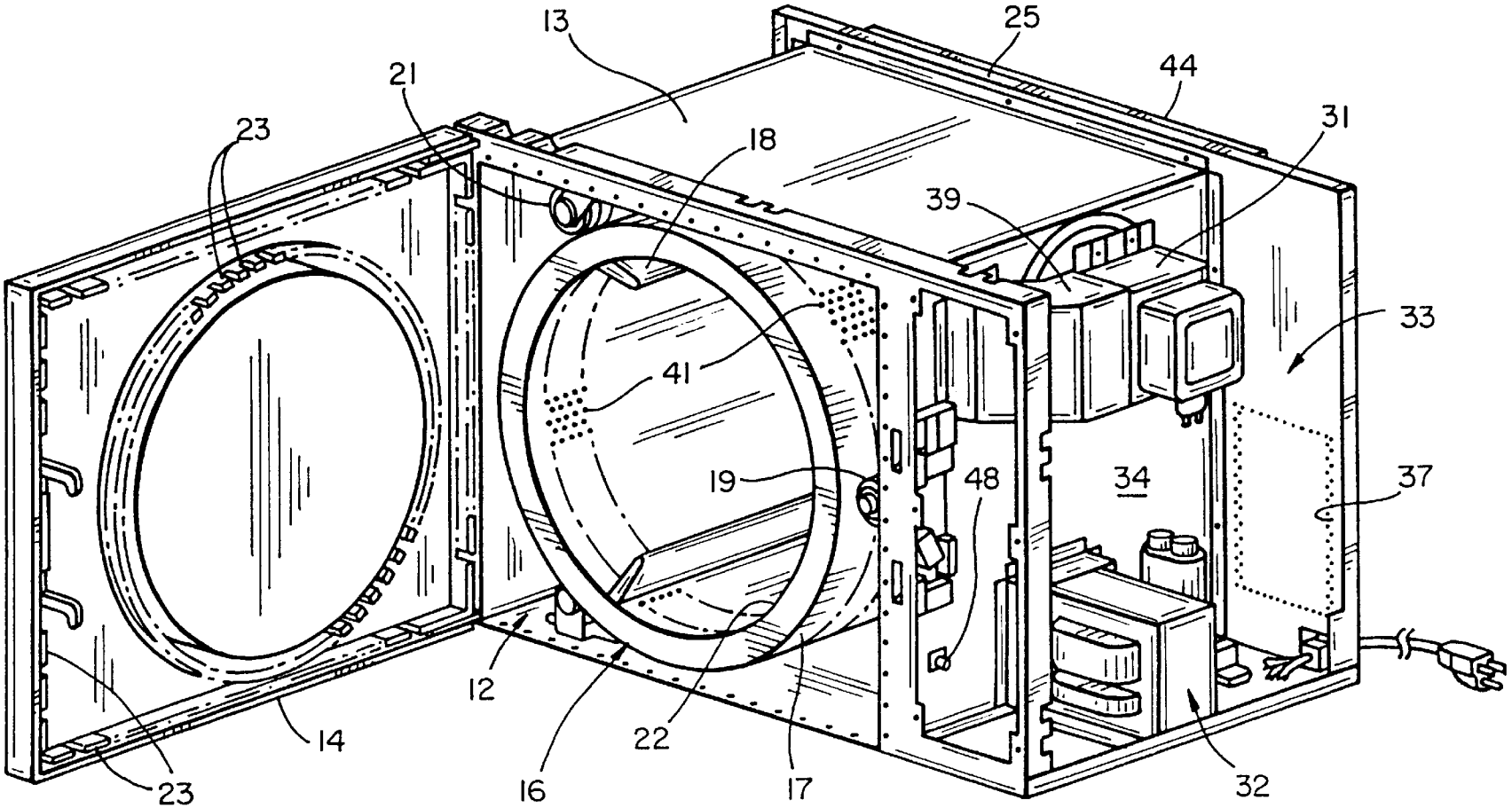
FIG. 3 is a front isometric view of the embodiment of FIG. 1, with the outer cabinet removed and the door in an open position.
Figure 4:
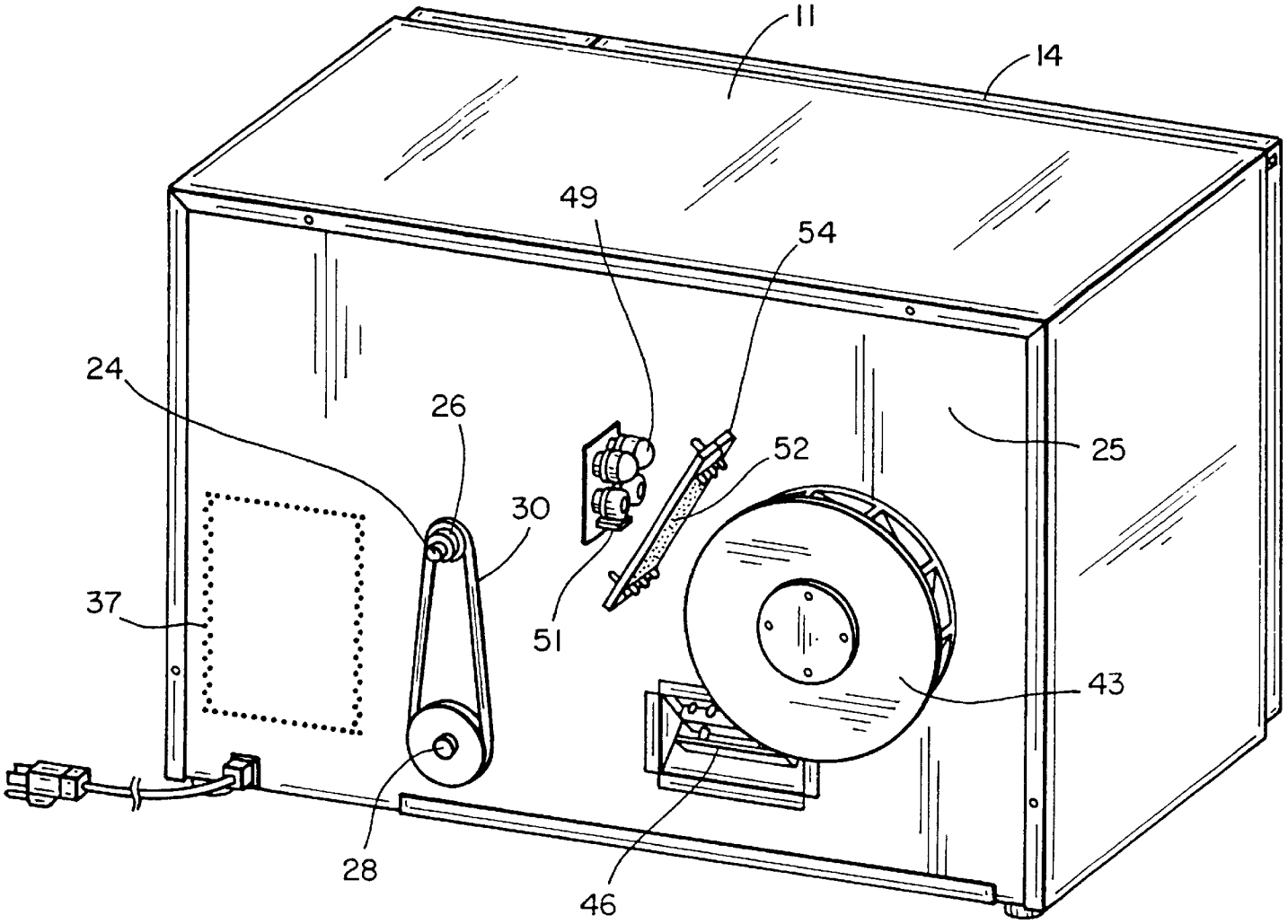
FIG. 4 is a rear isometric view similar to FIG. 2, with the rear cover and blower duct removed.
Figure 5:
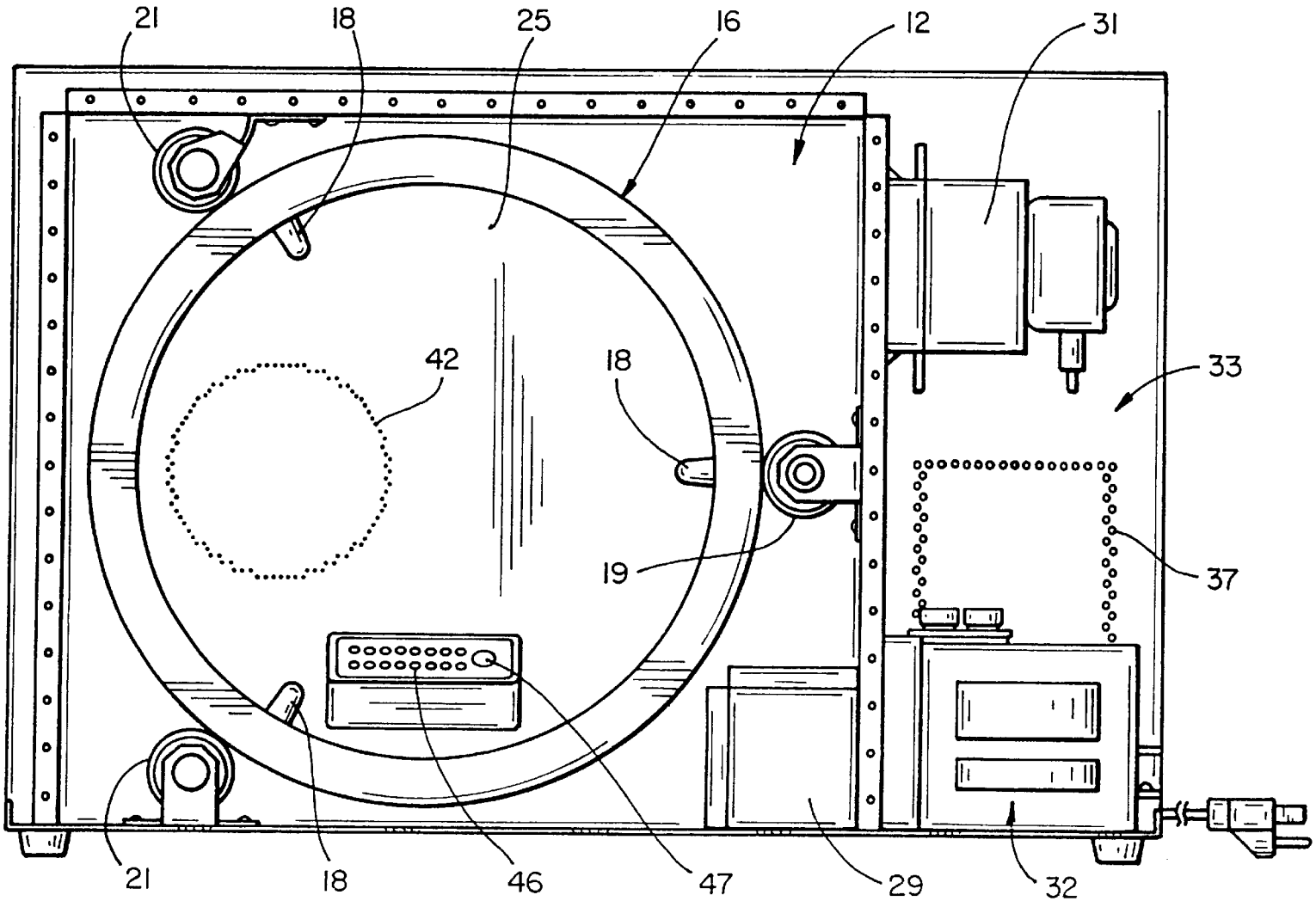
FIG. 5 is a front elevational view of the embodiment of FIG. 1, with the front side of the outer cabinet removed.
Figure 6:
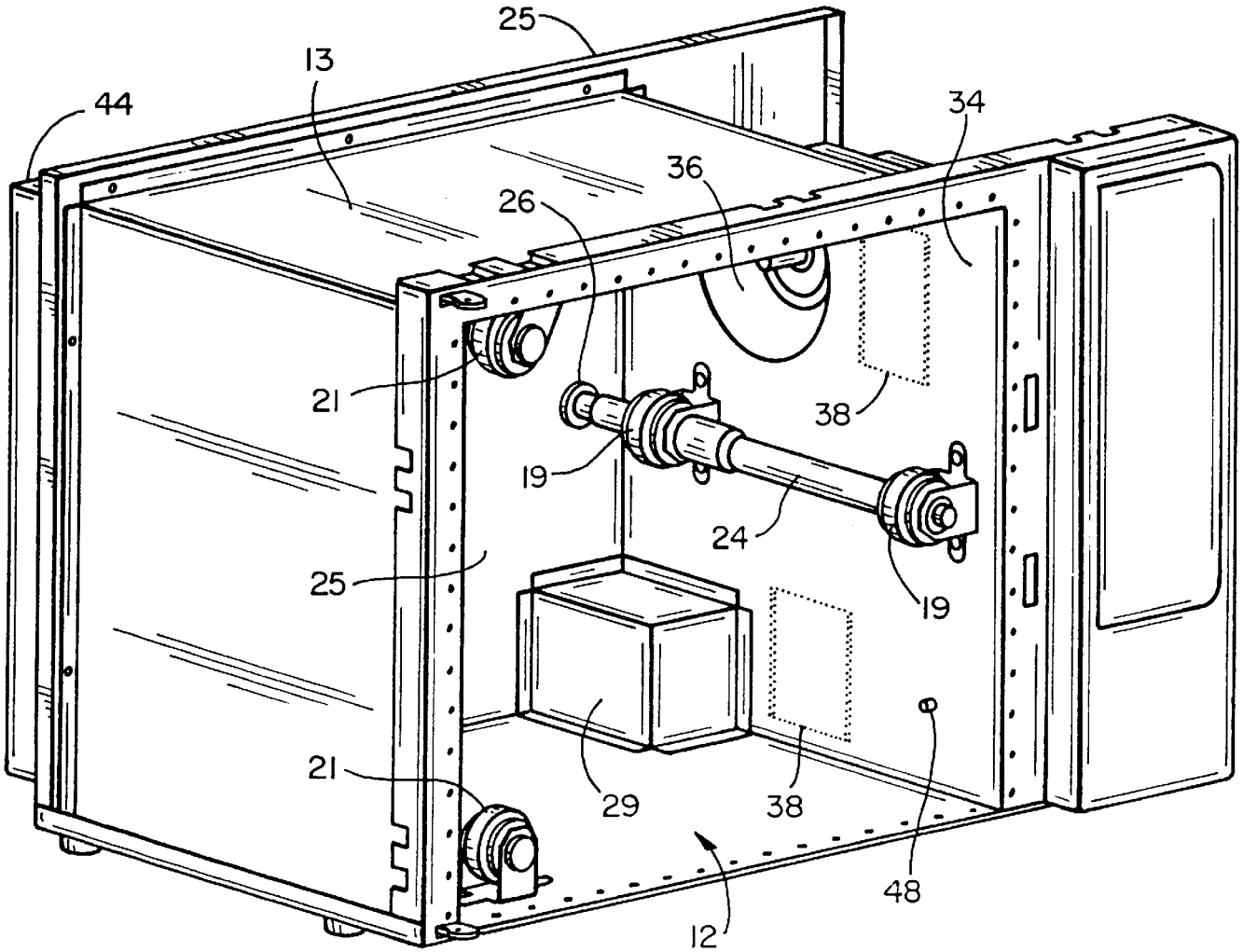
FIG. 6 is a front isometric view of the embodiment of FIG. 1, with the outer cabinet and the drum removed.
Figure 7:
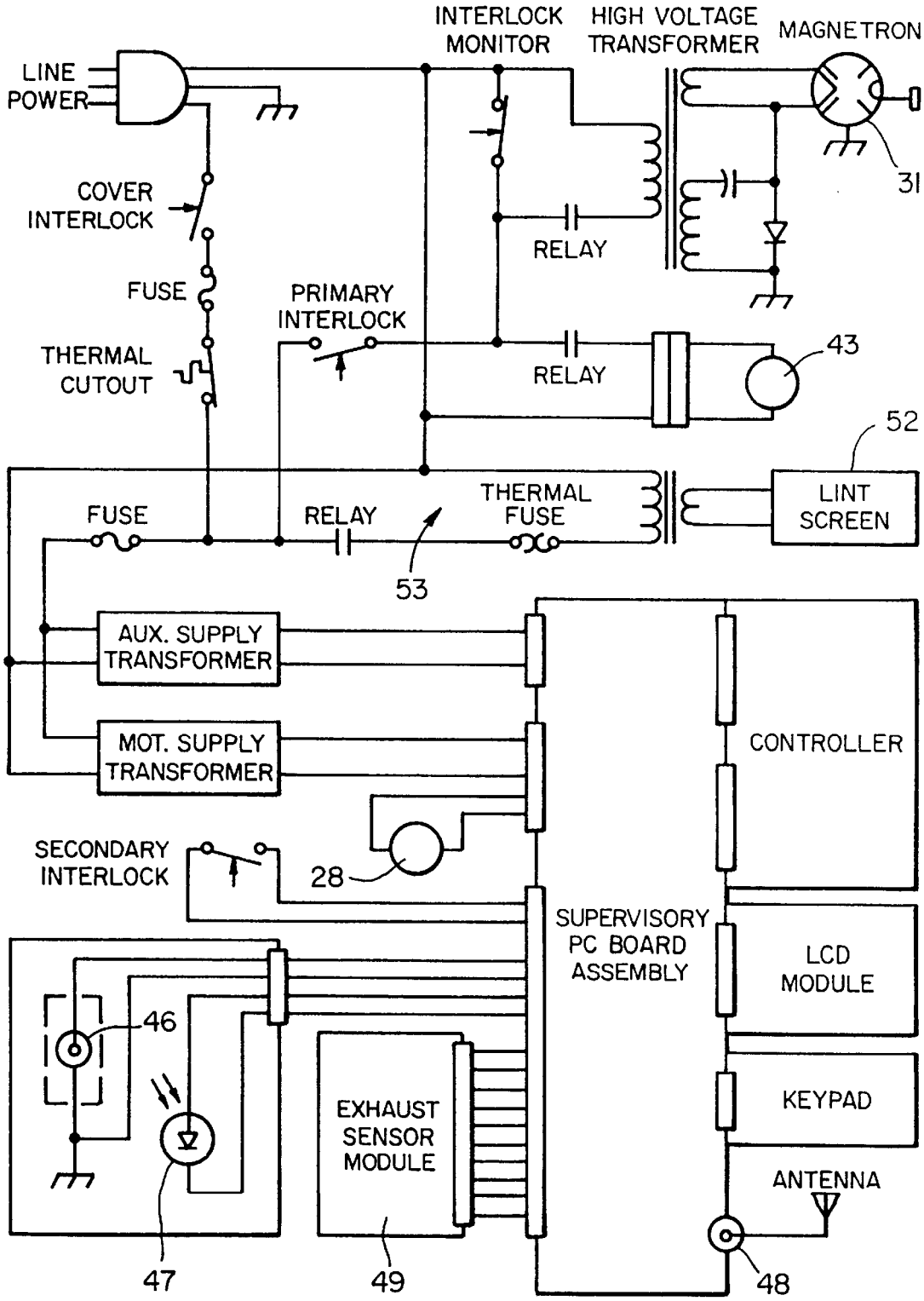
FIG. 7 is a circuit diagram for the embodiment of FIG. 1.

As illustrated in FIG. 1, the dryer has a generally rectangular outer cabinet 11 of a size and shape similar to a conventional microwave oven. It is small enough to be placed on a countertop, and has a volume on the order of 2–3 cubic feet. In one embodiment, for example, the cabinet has a height on the order of 16 inches, a width on the order of 24 inches, and a depth on the order of 17 inches.

A drying chamber 12 is formed inside the cabinet by a microwave-tight enclosure 13, commonly known as a Faraday cage. The front side of the enclosure is provided with a hinged access door 14.

A non-metallic basket or drum 16 having a cylindrical side wall 17 with radial vanes 18 is mounted within the drying chamber for tumbling the clothes as they are being dried. This drum is mounted on rollers 19, 21 for rotation about a horizontally extending axis, with an open end 22 of the drum at the front of the enclosure. Reactive choke seals 23 are mounted on the inner side of access door 14 in a circular pattern of slightly greater diameter than the drum and around the periphery of the door to prevent microwave leakage.

Rollers 19 are drive rollers, and rollers 21 are idlers. The drive rollers are mounted on a non-metallic shaft 24 which passes through the rear wall 25 of the enclosure in a bushing 26 having a length and diameter such that the bushing acts as a microwave choke which prevents the leakage of microwave energy from the chamber. A drive motor 28 for the rollers is mounted in a shielded housing 29 in a lower, rear corner of the drying chamber, and operably connected to the shaft by a drive belt 30 to the rear of back wall 25.

A microwave generator 31 and a power supply 32 are mounted in a compartment 33 within the cabinet adjacent to the side wall 34 of the microwave enclosure. The microwave generator is of conventional design and includes a magnetron which receives operating power from the power supply. Microwave energy is introduced into the drying chamber from the magnetron through a port 36 in the side wall of the enclosure.

Means is provided for circulating air past the magnetron and power supply components and through the drying chamber in order to transfer heat from the heat generating components to the clothes in the drum. This serves the dual purpose of cooling the magnetron and the power supply and further drying the clothes in the drum. This means includes a plurality of openings 37 in rear wall 25 at the back of the compartment 33 in which the magnetron and the power supply are located, openings 38 in the side wall 34 of the enclosure, a duct 39 which directs air through openings 38, a band of openings 41 in the side wall of the drum in alignment with openings 38, openings 42 in the rear wall of the enclosure roughly in axial alignment with the drum, and a blower 43 mounted on the rear wall outside the enclosure. The openings in the walls of the enclosure are small enough to cut off microwave energy and prevent leakage.

The blower is housed within cover 44 which is mounted on the outer side of rear wall 25, with openings 45 in the cover through which the air is exhausted.

The blower draws air out of the drying chamber through the open rear end of the drum and through openings 42 to create a slightly negative pressure within the chamber. This causes air to be drawn into the drum from the magnetron/power supply compartment 33 through the openings 38 in the side wall of the enclosure and the openings 41 in the side wall of the drum. This, in turn creates a slight negative pressure in compartment 33, which causes air to be drawn into that compartment through openings 37 in the rear wall of the cabinet. Heat dissipated by the magnetron and power supply components is transferred to the circulating air by convection, which serves to cool the components sufficiently to prevent them from overheating.

The warm air enters the drum through the openings 41 and passes axially through the drum, exiting through the opening at the rear of the drum. This facilitates the removal of moisture from the clothes and enhances the overall efficiency of the dryer.

The level of moisture in the clothes is monitored by a sensor 46 which is mounted on the rear wall 25 of the enclosure in position to be contacted intermittently by the tumbling clothes in the drum. The electrical resistance of the sensor is monitored, and when the resistance reaches a level indicating that the clothes are dry, the magnetron is shut down. This sensor is described in greater detail in U.S. Pat. No. 5,661,227.

A photodiode detector 47 is also mounted on the rear wall of the enclosure and connected to suitable circuitry for terminating dryer operation in the event of arcing due to the presence of incompatible metal objects within the drying chamber.

An electric field probe 48 is mounted in the side wall 34 of the enclosure and connected to a diode detector circuit for monitoring the electric field within the drying chamber and terminating dryer operation in the event of excessively high electric fields.

A plurality of gas sensors 49 are mounted on the rear wall of the enclosure outside the drying chamber in the path of the air exhausted from the chamber. These sensors and their associated circuitry monitor the exhaust gas for the presence of combustion gases and terminate dryer operation before a fire can break out. This system is described in detail in U.S. Pat. No. 5,606,804.

One of the gas sensors is a humidity sensor 51 which monitors the humidity in the exhaust gas to help determine the completion of the drying cycle.

A wire mesh lint screen 52 is placed in the path of the air flow to gas sensors 49 and humidity sensor 51 to prevent lint from accumulating on and causing faulty operation of the sensors. The dryer controls include an electrical circuit 53 that periodically passes a high electric current through the lint screen to burn off accumulated lint. The lint screen is mounted on ceramic insulators 54 that isolate the screen thermally and electrically from the surrounding metal structures.

The invention has a number of important features and advantages. It provides a highly efficient and very compact microwave clothes dryer which is small enough to be place on a countertop or other convenient location. The air which circulates through the magnetron and power supply compartment and through the drying chamber effectively transfers heat from the power supply and magnetron components to the clothes in the drum, thereby cooling the heat generating components and supplementing the action of the microwave energy in drying the clothes in the drum.

It is apparent from the foregoing that a new and improved microwave clothes dryer and method have been provided. While only certain presently preferred embodiments have been described in detail, as will be apparent to those familiar with the art, certain changes and modifications can be made without departing from the scope of the invention as defined by the following claims.

What is claimed is:

1. A compact microwave clothes dryer, comprising a cabinet of a size small enough to be placed on a countertop, a microwave-tight enclosure forming a drying chamber within the cabinet, a rotatable drum in the drying chamber for holding clothes to be dried, a microwave generator mounted inside the cabinet and outside the enclosure, means for introducing microwave energy from the generator into the drying chamber to dry clothes in the drum, a power supply mounted within the cabinet and outside the enclosure for supplying operating power to the microwave generator, and means for circulating air past the power supply and the microwave generator and through the drying chamber to transfer heat from the power supply and the microwave generator to the drying chamber to further dry-the clothes in the drum.

2. A compact microwave clothes dryer, comprising a cabinet, a microwave-tight enclosure forming a drying chamber within the cabinet, a rotatable drum in the drying chamber for holding clothes to be dried, a microwave generator mounted inside the cabinet and outside the enclosure, means for introducing microwave energy from the generator into the drying chamber to dry clothes in the drum, a power supply mounted within the cabinet and outside the enclosure for supplying operating power to the microwave generator, a plurality of openings in a wall of the enclosure near the power supply and the microwave generator, a plurality of openings in a side wall of the drum near the openings in the enclosure wall, and a blower mounted on another wall of the enclosure near an open end of the drum for drawing air into the drum through the openings and circulating the air past the power supply and the microwave generator and through the drying chamber to transfer heat from the power supply and the microwave generator to the drying chamber to further dry the clothes in the drum.

3. The microwave clothes dryer of claim 1 wherein the drum is rotatable about a horizontally extending axis.

4. The microwave clothes dryer of claim 3 including a plurality of rollers which peripherally engage the drum and constrain the drum for rotation about the horizontally extending axis.

5. The microwave clothes dryer of claim 4 wherein one of the rollers is a drive roller.

6. In a method of drying clothes in a compact microwave clothes dryer which is small enough to be placed on a countertop, the steps of: placing clothes in a drum in a drying chamber, rotating the drum about an axis, introducing microwave energy into the drying chamber to dry the clothes in the drum, supplying operating power to the microwave generator from a power supply, and circulating air past the power supply and the microwave generator and through the chamber to transfer heat from the power supply and the microwave generator to the drying chamber to further dry the clothes in the drum.

7. The method of claim 6 wherein the air is circulated through openings in a wall of the chamber near the power supply and the microwave generator and through openings in a wall of the drum near the openings in the chamber wall.

8. The method of claim 6 wherein the drum is rotated about a horizontally extending axis.

9. A compact microwave clothes dryer, comprising a countertop cabinet, a drying chamber within the cabinet, a drum within the drying chamber for receiving clothes to be dried, means including a microwave generator for introducing microwave energy into the chamber to dry clothes in the drum, and means for circulating air past the microwave generator and into the chamber to transfer heat from the microwave generator to the drying chamber to further dry the clothes in the drum.

10. The microwave clothes dryer of claim 9 further including a power supply for supplying operating power to the microwave generator, and the air also being circulated past the power supply to carry heat from the power supply to the drying chamber.

11. A compact microwave clothes dryer, comprising a generally rectangular cabinet having a volume on the order of 2–3 cubic feet;

a microwave-tight enclosure of lesser volume within the cabinet;

a drum having a generally cylindrical side wall and an open end mounted in the enclosure for rotation about a horizontally extending axis;

means including a microwave generator mounted inside the cabinet and outside the enclosure for introducing microwave energy into the enclosure to dry clothes in the drum;

a plurality of openings in a first side wall of the enclosure near the microwave generator;

a plurality of openings in the side wall of the drum near the openings in the first side wall of the enclosure;

and a blower mounted on a second side wall of the enclosure adjacent to the open end of the drum for drawing air past the microwave generator, through the openings in the first side wall of the enclosure and the side wall of the drum, and out through the open end of the drum to transfer heat from the microwave generator to the clothes in the drum.

12. The compact microwave clothes dryer of claim 11 further including a power supply mounted near the microwave generator so that the air also circulates past the power supply and carries heat from the power supply to the clothes in the drum.

13. The compact microwave clothes dryer of claim 11 including a plurality of rollers which peripherally engage the drum and constrain the drum for rotation about the horizontally extending axis.

14. The microwave clothes dryer of claim 13 wherein one of the rollers is a drive roller.

* * * * *